US006113994A

United States Patent [19]

Ochoa

[11] Patent Number: 6,113,994

[45] Date of Patent: Sep. 5, 2000

[54] PARTIALLY TRANSPARENT HANGING FIGURINE

[76] Inventor: Maureen Ochoa, 347 S. 3rd St., Apt. 1C, Brooklyn, N.Y. 11211

[21] Appl. No.: 09/084,297

[22] Filed: May 26, 1998

[51] Int. Cl.[7] ..... B44F 1/06; B44F 1/00; B44F 3/00

[52] U.S. Cl. ..... 428/7; 428/690; 428/29; 428/38; 428/542.2; 428/542.6

[58] Field of Search ..... 428/7, 27, 38, 428/542.2, 542.6, 131, 134, 135, 138, 670, 620; 282/301.36; D11/132, 136, 160, 157, 121, 128; 446/219, 228; 40/542, 543, 617

[56] References Cited

U.S. PATENT DOCUMENTS

| | | | |
|---|---|---|---|
| 764,207 | 7/1904 | Robinson | 428/690 |
| 1,244,058 | 10/1917 | Langer | 252/301.36 |
| 2,190,627 | 2/1940 | Payberg | 428/38 |
| 3,528,079 | 9/1970 | Birch | 46/157 |
| 4,015,364 | 4/1977 | Oquite | 46/11 |
| 4,253,266 | 3/1981 | Bajo | 46/11 |
| 5,607,734 | 3/1997 | Gonzalez | 428/7 |

FOREIGN PATENT DOCUMENTS

| | | | |
|---|---|---|---|
| 1129301 | 1/1957 | France | 428/38 |
| 308073 | 3/1929 | United Kingdom | 428/38 |

OTHER PUBLICATIONS

Alkema, *Tissue Paper Creations*, Sterling Publishing Co., pp. 39–42 no month, 1973.

*Primary Examiner*—C. Melissa Koslow
*Attorney, Agent, or Firm*—Michael I. Kroll

[57] ABSTRACT

A hanging figurine for display in a room. The hanging figurine includes a nontransparent material defining a desired shape and including a recess extending therethrough. A transparent material is positioned to cover the recess allowing light to pass through at least a portion of the figurine. A device is connected to said nontransparent material for connecting the figurine in a dangling manner within the room in which the figurine is to be displayed. The transparent material is of a desired color tinting any light passing therethrough to the desired color. The recess has a shape of one of a geometric object and a recognizable object such as the sun and moon. The connecting device is preferably a string and is connected to one of a wall, window and arm of an object with the room in which the figurine is displayed. Alternatively, the hanging figurine may be formed from an inner layer of a desired shape and a luminescent substance forming an outer layer covering the inner layer and causing the figurine to glow when positioned in a dimly lit area.

1 Claim, 6 Drawing Sheets

PARTIALLY TRANSPARENT HANGING FIGURINE

BACKGROUND OF THE INVENTION

1. Field of the Invention

The present invention relates generally to transparent figurines and, more specifically, to figurines able to hang from walls, windows or arms and branches of objects made of an at least partially transparent material and shaped in one of a geometric pattern and design representative of an occasion to be celebrated.

2. Description of the Prior Art

Numerous types of hanging ornaments have been provided in the prior art. For example, U.S. Pat. Nos. 3,528,079; 4,015,364; 4,253,266 and 5,607,734 all are illustrative of such prior art. While these units may be suitable for the particular purpose to which they address, they would not be as suitable for the purposes of the present invention as heretofore described.

It is thus desirable to provide a hanging figurine able to aid in alleviating a child's fear of the darkness. It is further desirable to provide a hanging figurine able to be made into a desired shape for use in decorating an area and/or celebrating an occasion.

A paperboard figurine having on its front surface a sheet type outer garment. The garment and figurine have registered apertures above the center of the figurine. A stud is pushed through the apertures rear end foremost from the front of the garment to the back of the figurine. The rear end of the stud is slightly larger than the apertures so that it will not permanently enlarge the apertures. The front end of the stud is enlarged and of an ornamental configuration. It has a flat back surface which rests against the portion of the garment covered thereby.

A piñata for enclosing a plurality of small items carried on a bottom wall in which the bottom wall is formed with a line of weakness for enabling it to break-away upon application thereto of a moderate force such as obtained by shaking so that the items bounce on the bottom wall or by a child grabbing a pull line attached to the bottom wall.

An improved collapsible and reusable piñata is disclosed, for use at parties and similar festive occasions. The pifiata comprises an outer shell portion which includes a frangible base member and an upwardly extending perimeter wall, the said outer shell being open at the upper side thereof. An inner shell portion, open at the bottom, is nestably received within the outer shell, and is axially telescopical with respect to the latter. Means attachable to an overhead point, engage with the upper shell portion, enabling suspension of same from the overhead point. Upon suspension, gravitational force axially displaces the outer shell portion below the inner portion, to thereby effect a fully expanded or open condition for the piñata. Means are provided for restraining further displacement between the said shell portions, upon the fully telescoped condition being obtained. In use the frangible base is broken, e.g. by tearing, permitting the interior contents of the piñata to discharge.

An expansible ornament assembly comprising an expansible form having an open position and a closed position and constructed of a lightweight material such as tissue paper. The form has cavities formed therein and includes two ends wherein each of the two ends is attached to at least one base. The assembly includes means for attaching each base at each end thereof to a flat planar surface. When in the open position, the expansible ornament assembly is adapted to display a three dimensional object or another simulative representation such as a letter, phrase, or the like. The ornament assembly may be used in combination with a gift wrapping sheet which coordinates in some respect with the displayed three dimensional object.

SUMMARY OF THE PRESENT INVENTION

The present invention relates generally to hanging figurines and, more specifically, to figurines able to hang from walls, windows or arms and branches of objects made of an at least partially transparent material and shaped in one of a geometric pattern and design representative of an occasion to be celebrated.

A primary object of the present invention is to provide a hanging figurine that will overcome the shortcomings of prior art devices.

Another object of the present invention is to provide a hanging figurine which is able to at least partially allow light to pass therethrough.

A further object of the present invention is to provide a hanging figurine including at least one geometric shape made of translucent material positioned therein for allowing the light to pass therethrough.

A yet further object of the present invention is to provide a hanging figurine wherein the geometric shapes are in the form of at least one of numbers, letters and recognizable objects such as a sun or moon shape.

A still further object of the present invention is to provide a hanging figurine able to provide a decorative element for a child's room while aiding in the alleviation of the child's fear of darkness.

Another object of the present invention is to provide a hanging figurine that is simple and easy to use.

A still further object of the present invention is to provide a hanging figurine that is economical in cost to manufacture.

Additional objects of the present invention will appear as the description proceeds.

A hanging figurine for display in a room is disclosed by the present invention. The hanging figurine includes a nontransparent material defining a desired shape and including a recess extending therethrough. A transparent material is positioned to cover the recess allowing light to pass through at least a portion of the figurine. A device is connected to said nontransparent material for connecting the figurine in a dangling manner within the room in which the figurine is to be displayed. The transparent material is of a desired color tinting any light passing therethrough to the desired color. The recess has a shape of one of a geometric object and a recognizable object such as the sun and moon. The connecting device is preferably a string and is connected to one of a wall, window and arm of an object with the room in which the figurine is displayed. Alternatively, the hanging figurine may be formed from an inner layer of a desired shape and a luminescent substance forming an outer layer covering the inner layer and causing the figurine to glow when positioned in a dimly lit area.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
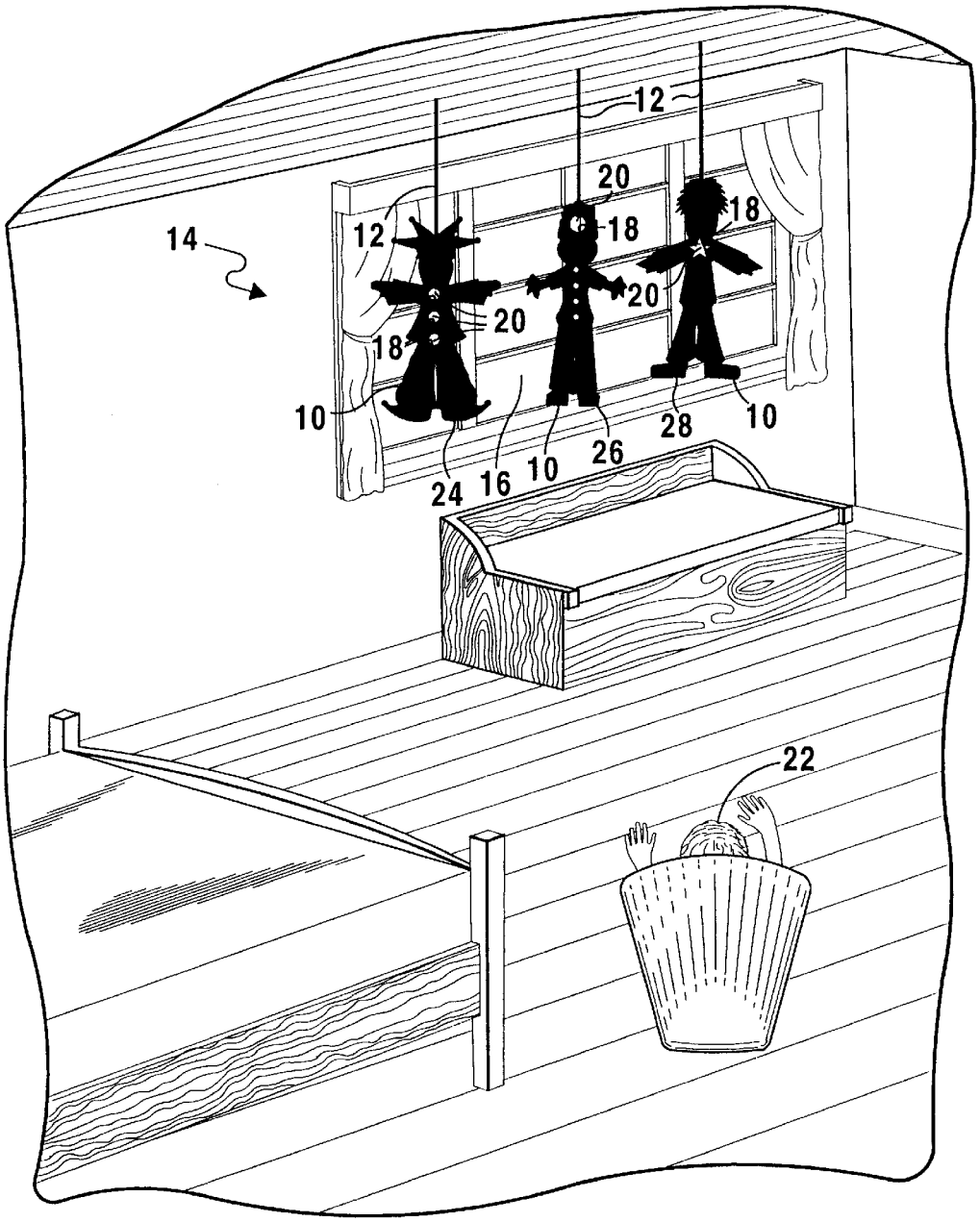
FIG. 1 is a perspective view of a bedroom in which a hanging figurine of the present invention is positioned in front of a window allowing light to pass therethrough.

Turning now descriptively to the drawings, in which similar reference characters denote similar elements throughout the several views, the Figures illustrate the hanging figurine of the present invention. With regard to the reference numerals used, the following numbering is used throughout the various drawing figures.

10 hanging figurine of the present invention

12 string connected to hanging figurine

14 room in which hanging figurine is positioned

16 window in front of which hanging figurines are positioned

18 recess in hanging figurine

20 translucent material covering recess

22 child/infant viewing hanging figurines

24 clown shaped hanging figurine

26 child wearing hat shaped hanging figurine

28 child with moppy hair shaped hanging figurine

30 luminescent substance coating hanging figurine

32 lines representing glowing of hanging figurines

34 sunlight passing through the window

36 outline forming shape of hanging figurine

38 cut out central section within outline

40 translucent material covering cut out central section

42 lines indicating tinted light passing through translucent material

44 arm of hanging figurine

46 outer surface of hanging figurine

48 non translucent paper forming shape of hanging figurine

DETAILED DESCRIPTION OF THE PREFERRED EMBODIMENT

Turning now descriptively to the drawings, in which similar reference characters denote similar elements throughout the several views, FIGS. 1 through 8 illustrate the hanging figurine of the present invention indicated generally by the numeral 10.

Hanging figurines 10 in accordance with the present invention are illustrated in FIG. 1 hanging from a string 12 in a child's room 14. The hanging figurines 10 are positioned in front of a window 16. Each of the hanging figurines 10 include at least one recess 18 therein, the recess 18 being covered by a translucent material 20. The translucent material 20 allows light entering the window 16 to pass therethrough. The light passing therethrough can be detected by a child 22 and in addition to providing a decorative element to the room 14, the hanging figurines 10 may provide entertainment for the child 22. The translucent material 20 may be of any desired color and thereby cause the light passing therethrough to be tinted to the color of the translucent material 20. The use of different colored translucent material 20 provides for an added decorative feature to the hanging figurine 10 while also creating a desired effect and aiding a child 22 in identifying and distinguishing between different colors.

Each hanging figurine 10 may be formed in any desired shape such as a clown 24, a child wearing a hat 26 or a child with moppy hair 28. While preferred shapes for the hanging figurine 10 are shown and described herein, those of ordinary skill in the art who have read this description will appreciate that there are numerous other forms which the hanging figurine 10 may be shaped and therefore, that all such shapes are to be considered as equivalent to the shapes described herein.

Each recess 18 extending through a hanging figurine 10 may also be formed in any desired shape such as a geometric object, a number, a letter, a sun, a moon, etc,. While preferred shapes for the recesses 18 are shown and described herein, those of ordinary skill in the art who have read this description will appreciate that there are numerous other forms which the recesses 18 may be shaped and therefore, that all such shapes are to be considered as equivalent to the shapes described herein.

Figure 2:
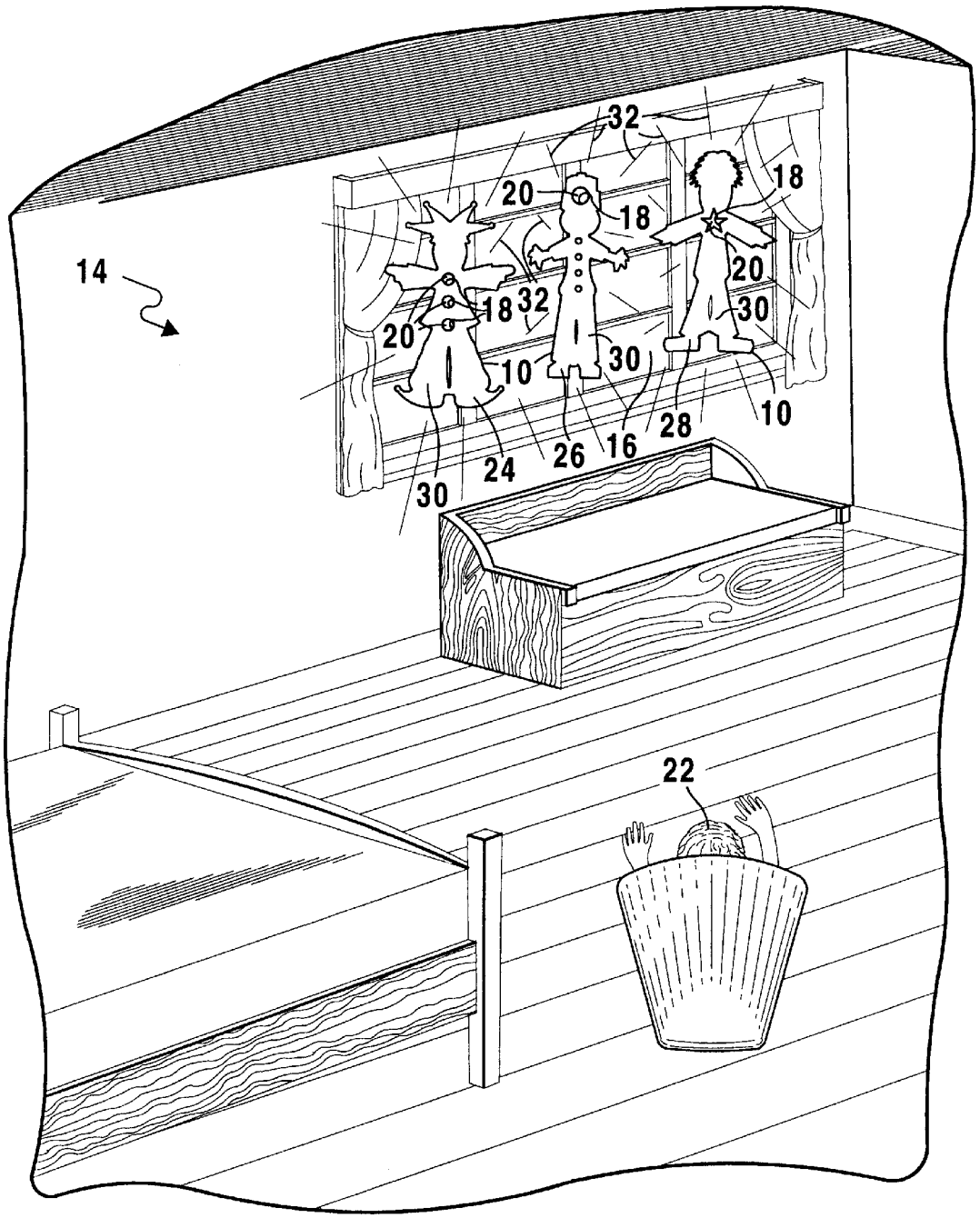
FIG. 2 is a perspective view of the hanging figurines of the present invention, the hanging figurines being coated by a luminescent paint thereby allowing the hanging figurines to glow in the dark.

FIG. 2 illustrates the room 14 including the hanging figurines 10 positioned in front of the window 16. In this figure, the hanging figurines 10 are illustrated at night time. The hanging figurines 10 are covered in a luminescent substance 30 causing the hanging figurines 10 to glow in the dark. The luminescent substance is preferably glow-in-the-dark paint. However, any substance able to provide a glow or emit a light when in a dimly lit area may be used as the luminescent substance. The glowing of the hanging figurines 10 is represented by the lines numbered 32. The luminescent substance 30 causes the hanging figurines 10 to be visible in the dark and thus provide an entertainment device for infants 22 at all hours of the day. Hanging figurines 10 covered in the luminescent substance 30 may be provided without recesses 18 extending therethrough.

Figure 3:
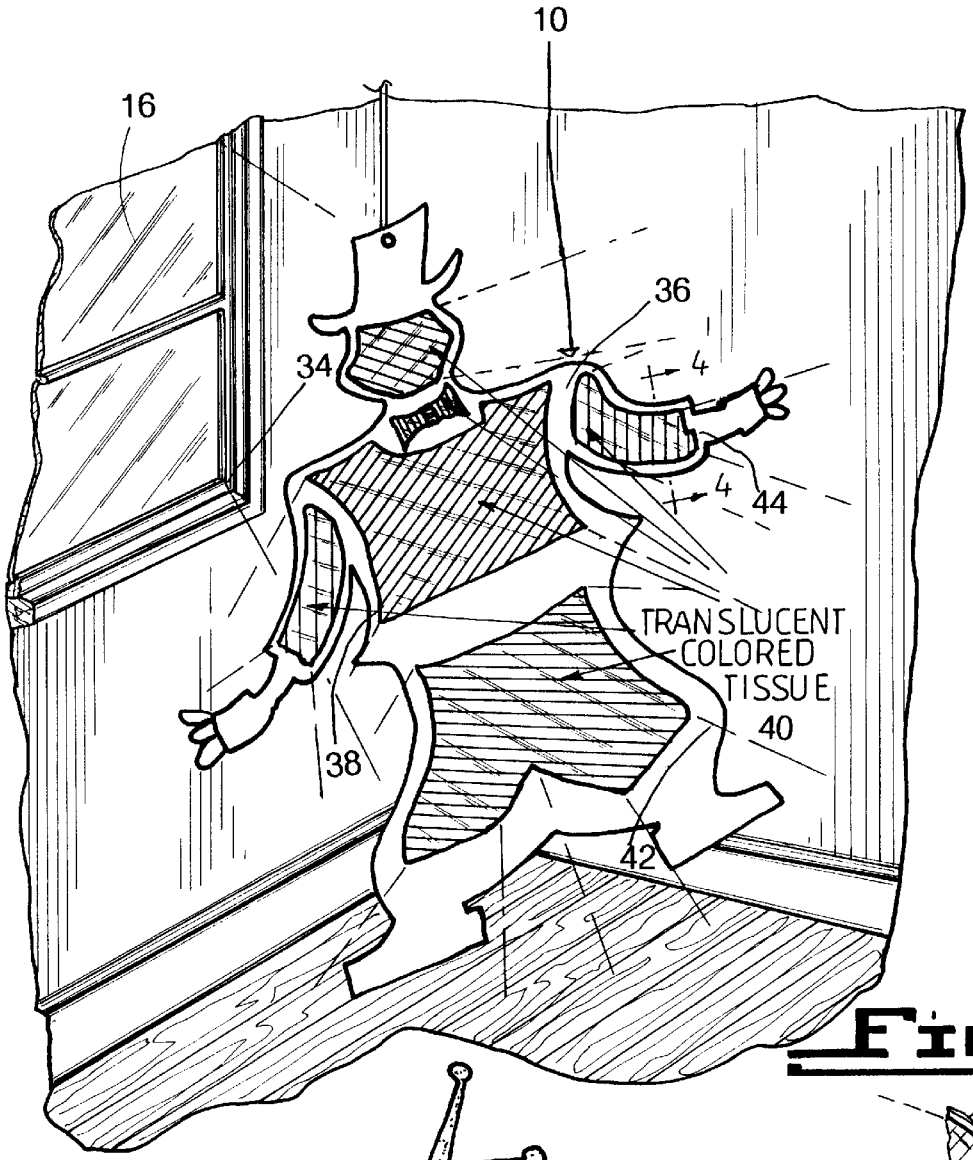
FIG. 3 is a perspective view of the hanging figurine of the present invention made of paper and a translucent material.

FIG. 3 illustrates an enlarged view of a hanging figurine 10 positioned in front of a window 16 through which sunlight passes. The sunlight is represented by the lines labeled with the numeral 34. The hanging figurine 10 includes an outline 36 forming the shape of the figurine 10 and a cut out central portion 38. The cut out central portion 38 is covered by a translucent colored tissue 40. The translucent colored tissue 40 allows light to pass therethrough as is evidenced by the lines labeled 42. The cut out central portion 38 is illustrated in the present embodiment as being divided into a plurality of subsections. Forming the cut out central portion 38 as a plurality of subsections is for purposes of design and effect. Each subsection may be covered by a different or similar color translucent tissue 40 as desired. However, the cut out central portion 38 may also be formed of a single cut out portion 38.

Figure 4:
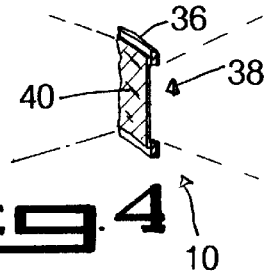
FIG. 4 is a cross-sectional view of the hanging figurine of the present invention taken along the line 4—4 of FIG. 3.

A cross-section of a portion of the hanging figurine 10 is illustrated in FIG. 4. This figure is taken along the line 4—4 of FIG. 3 and illustrates one arm 44 of the hanging figurine 10. As can be seen from this figure, the outline 36 forms the outer shape of the hanging figurine 10 and the cut out central portion 38 forms the portion through which light will pass thereby controlling the effect produced by the hanging figurine 10. The cut out central section 38 is covered by the translucent tissue 40 thereby tinting any light passing through the cut out portion 38 and creating a desired effect.

Figure 5:
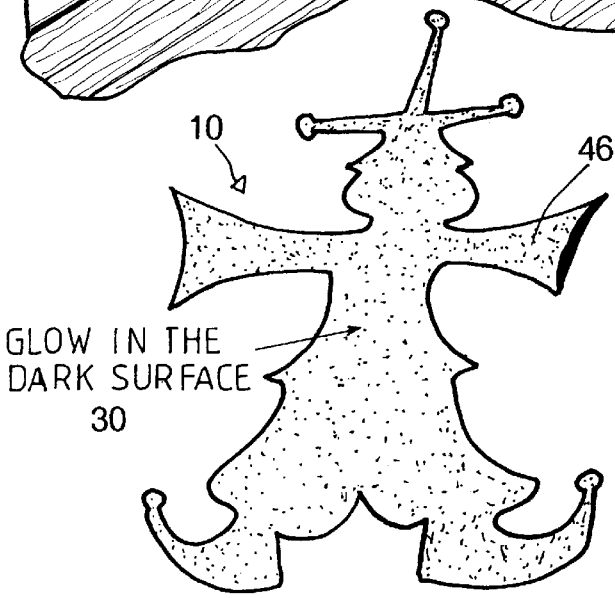
FIG. 5 is a perspective view of the hanging figurine of the present invention coated with a luminescent material.

A hanging figurine 10 in which the entire surface 46 thereof is covered in a luminescent substance 30 is illustrated in FIG. 5. Hanging figurines 10 covered in the luminescent substance 30 as shown in this figure may be provided without recesses 18 extending therethrough. The luminescent substance 30 may fully or partially cover the hanging figurine 10 to create any desired effect or design for the figurine 10. As the area surrounding the figurine 10 becomes darker, the luminescent substance 30 begins to glow to create a desired effect.

Figure 6:
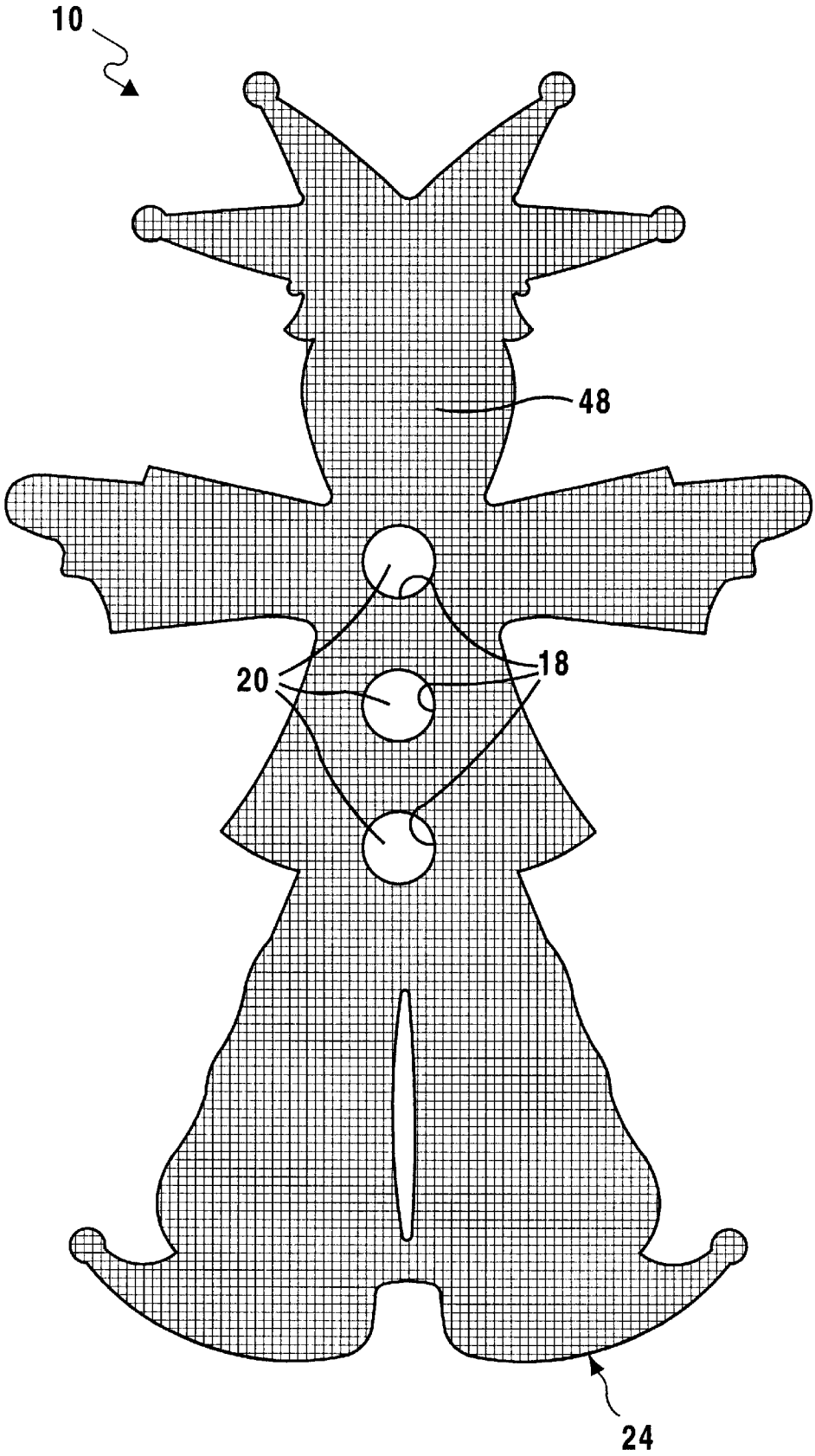
FIG. 6 is a front elevational view of the hanging figurine of the present invention in the shape of a clown and including buttons formed from translucent material.

A figurine 10 in the shape of a clown 24 is illustrated in FIG. 6. This figurine is formed from a nontranslucent substance 48 and includes recesses 18 extending therethrough at desired strategically placed locations. In this figure, the recesses 18 are positioned to represent pom poms on the shirt of the clown. The recesses 18 are covered by a translucent material 20 allowing light to pass therethrough. The translucent material 20 is colored to thereby tint the light to the color of the translucent material 20 as it passes therethrough and create a desired effect.

Figure 7:
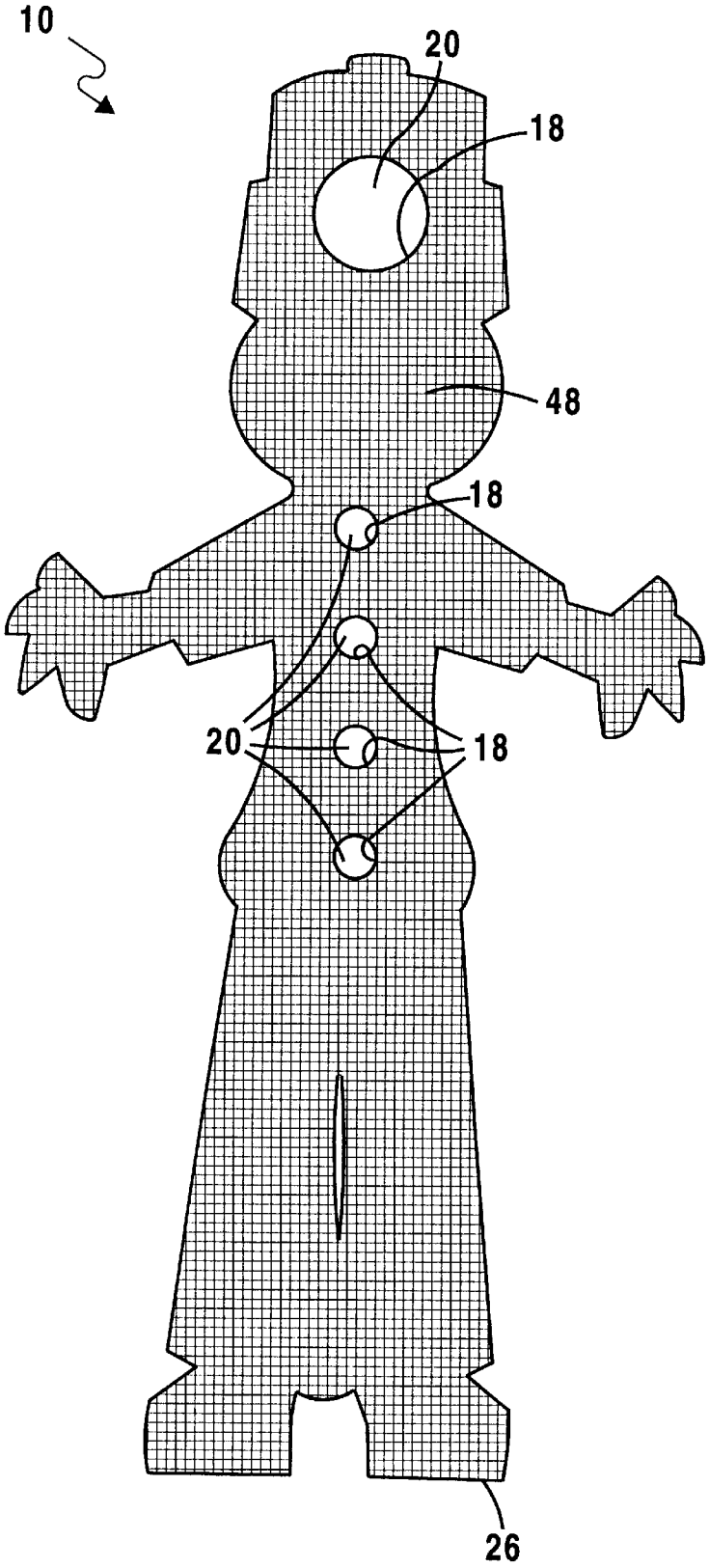
FIG. 7 is a front elevational view of the hanging figurine of the present invention in the shape of a child including buttons and a hat formed from a translucent material.

A figurine 10 in the shape of a boy wearing a hat 26 is illustrated in FIG. 7. This figurine is formed from a nontranslucent substance 48 and includes recesses 18 extending therethrough at desired strategically placed locations. In this figure, the recesses 18 are positioned to represent buttons on the shirt and a pom pom on the hat of the boy 26. The recesses 18 are covered by a translucent material 20 allowing light to pass therethrough. The translucent material 20 is colored to thereby tint the light to the color of the translucent material 20 as it passes therethrough and create a desired effect.

Figure 8:
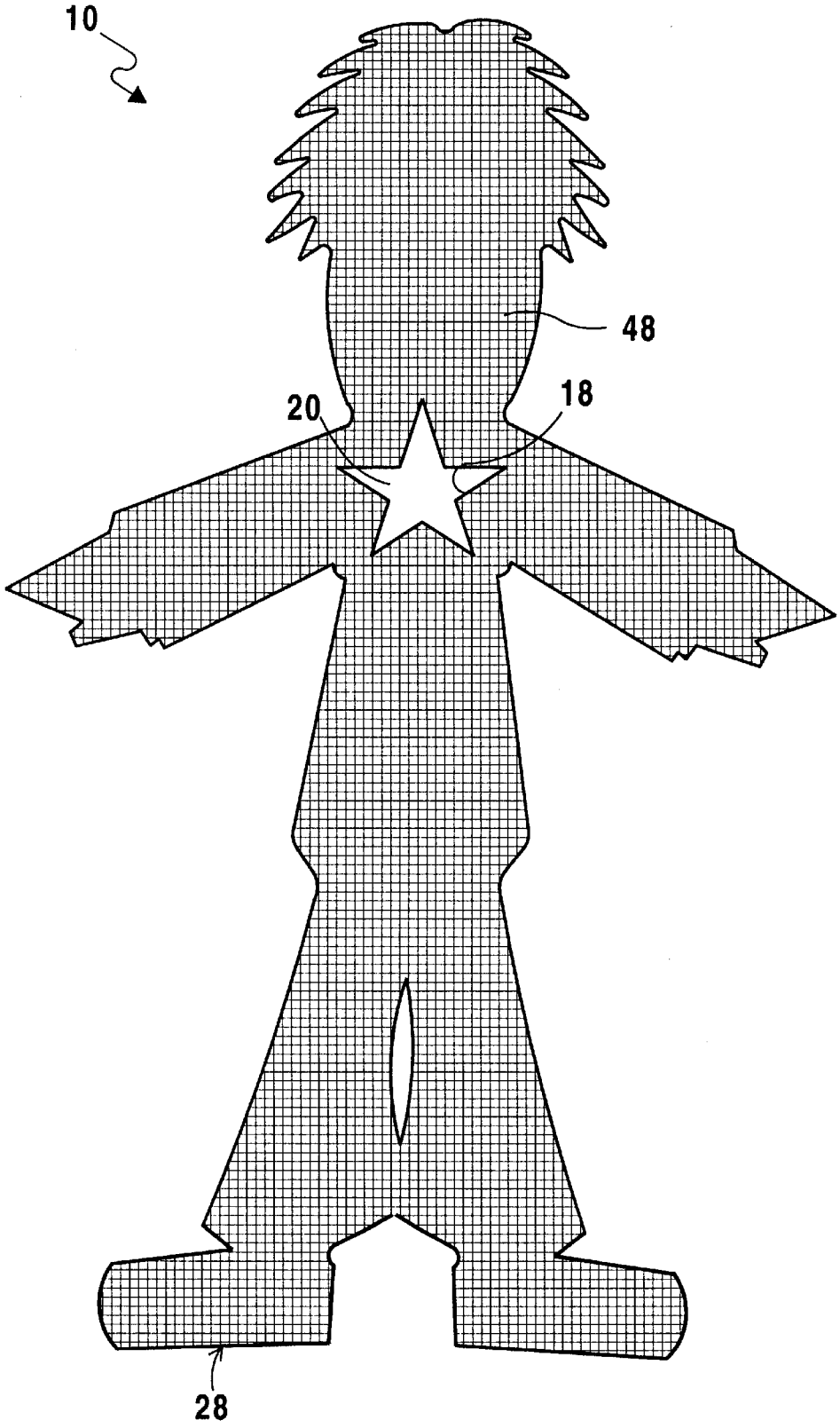
FIG. 8 is a front elevational view of the hanging figurine of the present invention in the shape of a child including a s tar formed from a translucent material positioned therein.

A figurine 10 in the shape of a boy with moppy hair 28 is illustrated in FIG. 8. This figurine is formed from a nontranslucent substance 48 and includes recesses 18 extending therethrough at desired strategically placed locations. In this figure, the recesses 18 are positioned to represent a star on the shirt of the boy. The recesses 18 are covered by a translucent material 20 allowing light to pass therethrough. The translucent material 20 is colored to thereby tint the light to the color of the translucent material 20 as it passes therethrough and create a desired effect.

The operation of the hanging figurine 10 will now be described with reference to the figures. In operation, the hanging figurine 10 includes a string or other connecting device 12 extending therefrom. The connecting device 12 is attached to a wall or surface of a room 14 allowing the hanging figurine 10 to dangle therefrom. If the figurine 10 includes recesses 18 extending therethrough and translucent material 20 covering the recesses 18, light that impinges thereon passes through the translucent material 20 and is tinted to appear as the color of the translucent material 20. The tinted light is directed onto a surface along its line of travel and forms an image representing the shape of the recess thereon. If the hanging figurine 10 is formed of luminescent material 30, as the room 14 in which it is dangling becomes darker, the figurine 10 begins to glow and create an effect in which the figurine is visible in the dark.

The dangling of the figurines 10 is able to attract an infant's attention for an extended period and thus entertain an infant 22. Furthermore, if the figurine 10 is made of luminescent material 30, the infant 22 will be distracted thereby as the room 14 becomes dark. This will allow an infant 22 to adjust to a dark room and thus alleviate their fear of the dark.

From the above description it can be seen that the hanging figurine of the present invention is able to overcome the shortcomings of prior art devices by providing a hanging figurine which is able to allow the passage of light through at least a portion thereof. The hanging figurine includes at least one geometric shape made of translucent material positioned therein for allowing the light to pass therethrough, the geometric shapes are in the form of at least one of numbers, letters and recognizable objects such as a sun or moon shape. The hanging figurine may be covered in a luminescent material allowing it to glow in the dark and is able to provide a decorative element for a child's room while aiding in the alleviation of the child's fear of darkness. Furthermore, the hanging figurine of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A hanging figurine for display in a room, said hanging figurine comprising:

a) a flat member formed into the shape of a clown made of nontransparent material having a coating of glow-in-the-dark paint and including a plurality of circular recesses extending therethrough strategically positioned in a mid section of said nontransparent material, each of said plurality of circular recesses representing a pom pom on said clown;

b) a translucent material positioned to cover each of said recesses, allowing light to pass through a portion of said figurine; and c) means comprising a string for suspending freely said figurine from the top thereof in front of a source of light to obtain a profile of said figurine with light passing through said recesses.

* * * * *